US007262373B2

(12) United States Patent
Miura et al.

(10) Patent No.: US 7,262,373 B2
(45) Date of Patent: Aug. 28, 2007

(54) MULTIFUNCTIONAL SWITCH

(75) Inventors: Seiki Miura, Okayama (JP); Yukio Hashimoto, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/497,358

(22) Filed: Aug. 2, 2006

(65) Prior Publication Data

US 2007/0062787 A1 Mar. 22, 2007

(30) Foreign Application Priority Data

Aug. 3, 2005 (JP) ..... 2005-224870

(51) Int. Cl.
*H01H 9/00* (2006.01)

(52) U.S. Cl. ..... 200/4; 200/14

(58) Field of Classification Search ..... 200/4, 200/11 R, 14, 11 A–11 TW, 17 R, 18, 336, 200/564, 570, 571
See application file for complete search history.

(56) References Cited

U.S. PATENT DOCUMENTS 6,262,378 B1 * 7/2001 Chou ..... 200/4
6,339,200 B1 * 1/2002 Shi et al. ..... 200/305
6,506,984 B2 * 1/2003 Tomita ..... 200/11 R
6,525,277 B2 * 2/2003 Oba et al. ..... 200/4
6,621,016 B2 * 9/2003 Ohba et al. ..... 200/4
7,087,848 B1 * 8/2006 Yamasaki et al. ..... 200/6 A
7,135,646 B2 * 11/2006 Tan ..... 200/4
7,145,087 B1 * 12/2006 Su et al. ..... 200/4

FOREIGN PATENT DOCUMENTS

JP 3-82535 8/1991

* cited by examiner

*Primary Examiner*—Michael A Friedhofer
(74) *Attorney, Agent, or Firm*—Wenderoth, Lind & Ponack, L.L.P.

(57) ABSTRACT

A multifunctional switch having a push button placed on an upper surface, and an operating lever protruding laterally from the side thereof. The push button on the upper surface is used to operate a push switch. The operating lever on the side is used to operate a rotary switch.

2 Claims, 7 Drawing Sheets

MULTIFUNCTIONAL SWITCH

FIELD OF THE INVENTION

The present invention relates to a multifunctional switch having a combination of a push switch and a spring-loaded self-resetting type rotary switch (hereinafter referred to simply as a rotary switch). The multifunctional switch of this invention can be used for a cellular phone, a digital still camera, and the like.

BACKGROUND OF THE INVENTION

FIG. 6 is an exploded perspective view of a multifunctional switch of the prior art, FIG. 7 an exterior view of the same switch, FIG. 8 a sectional view of the same switch, and FIG. 9 a plan view of a switch casing.

A push switch is provided inside circular wall 1A of switch casing 1 (refer to FIGS. 8 and 9). The push switch comprises contacts 2A and 2B, dome-like movable contact 6 made of a sheet metal, and push button 7. A peripheral rim of dome-like contact 6 is in contact with contact 2B. Contacts 2A and 2B are connected with terminals 4A and 4B respectively.

When push button 7 is pressed, the dome-like shape of movable contact 6 deforms elastically to come into contact with contact 2A, thereby making a continuity between terminals 4A and 4B. When the pressing force is removed from push button 7, movable contact 6 recovers its original dome-like shape by its elasticity, and breaks the continuity between terminals 4A and 4B.

A rotary switch is provided outside of circular wall 1A (refer to FIGS. 8 and 9). The rotary switch comprises contacts 3A, 3B and 3C, rotatable body 9, sliding contact 10 (refer to FIGS. 6 and 8), and spring 8. Contacts 3A, 3B and 3C are connected with terminals 5A, 5B and 5C respectively.

Rotatable body 9 having sliding contact 10 mounted to the underside thereof is engaged to circular wall 1A in a freely rotatable manner. A pair of bosses 9C provided on the underside of rotatable body 9 catch both ends of spring 8, which is disposed to protrusion 1B of switch casing 1 (refer to FIG. 9).

When a turning force is applied clockwise to rotatable body 9, boss 9C shown on the left side of FIG. 9 shifts upward while bending one end of spring 8 as illustrated by the dotted line. The other end of spring 8 is caught immovable by one of stoppers 1C on the right side. In this state, sliding contact 10 is in a position that contact shoes 10A and 10B are in contact with their respective contacts 3A and 3B, thereby making a continuity between terminals 5A and 5B.

When the turning force is removed, rotatable body 9 returns to its original angular position, or the neutral state, by the elasticity of spring 8. When rotatable body 9 comes into this state, the continuity is cut between terminals 5A and 5B because both contact shoes 10A and 10B of sliding contact 10 are on the surface of contact 3A.

When a turning force is applied counterclockwise to rotatable body 9, boss 9C shown on the right side shifts upward, and this makes a continuity between terminals 5A and 5C. When the turning force is removed, rotatable body 9 returns to the neutral state to break the continuity between terminals 5A and 5C in the same manner as described above.

In the multifunctional switch of the prior art described above, an operating knob, not shown, is attached to projections 9D on the upper side of rotatable body 9 to operate the rotary switch. In other words, operating means are located on the upper surface for both the push switch and the rotary switch. For use in the latest electronic apparatuses, however, there is a demand for multifunctional switches of a type having a combination of a vertically operable push switch and a laterally operable rotary switch.

Japanese Utility Model Unexamined Publication, No. 1991-82535 is one example of the known prior art documents related to conventional multifunctional switches of the type discussed above.

SUMMARY OF THE INVENTION

A multifunctional switch of the present invention comprises a push switch provided inside a circular wall on a switch casing and a spring-loaded self-resetting type rotary switch provided outside of the circular wall. The rotary switch comprises a plurality of contacts, a rotatable body engaged to the circular wall in a rotatable manner, a sliding contact mounted to the rotatable body for making sliding contact with the plurality of contacts, a spring disposed to the rotatable body for providing a turning force to return the rotatable body to a neutral position, and an operating lever protruding laterally from the side of the rotatable body beyond the side of the switch casing.

In the multifunctional switch of this invention, the rotary switch can be operated by using this operating lever in a plane orthogonal to an operating direction of the push switch.

DETAILED DESCRIPTION OF PREFERRED EMBODIMENT

Description is provided hereinafter of an exemplary embodiment of the present invention with reference to the accompanying drawings.

Figure 1:
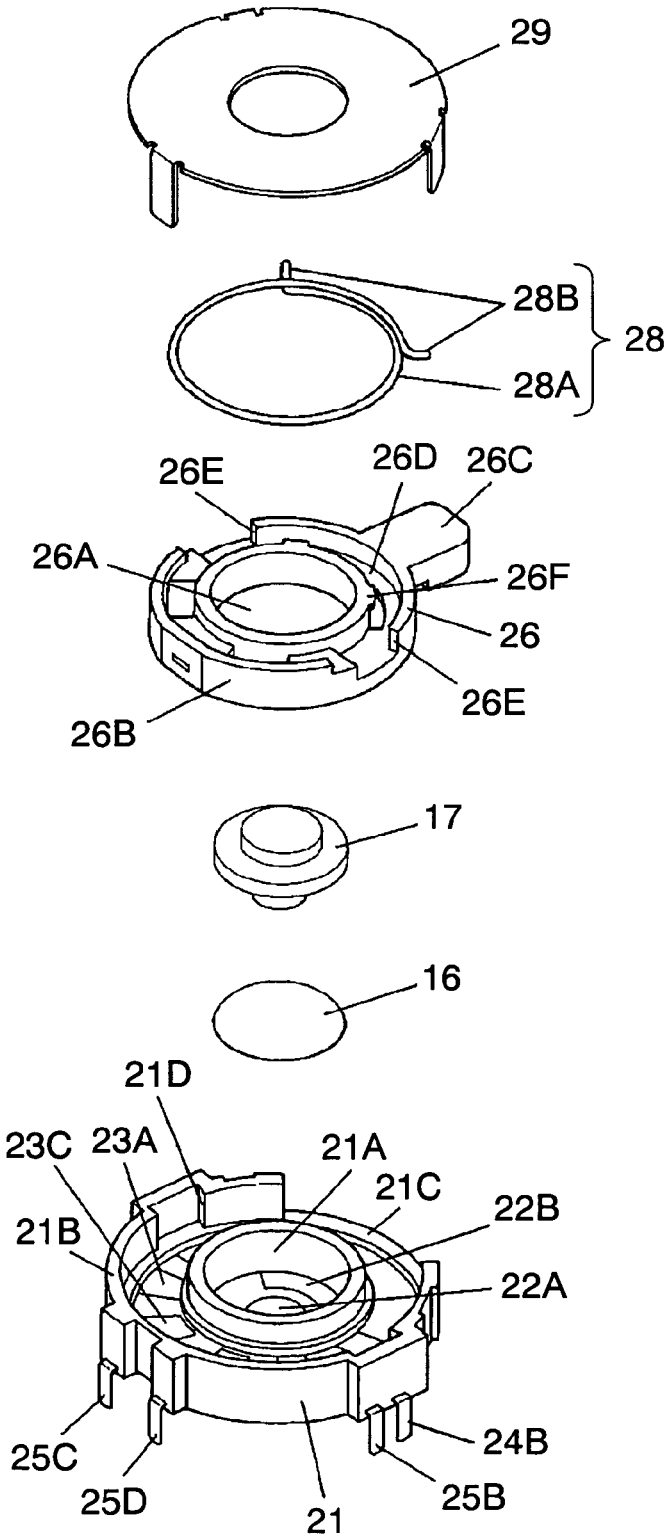
FIG. 1 is an exploded perspective view of a multifunctional switch according to an exemplary embodiment of the present invention.
Figure 2:
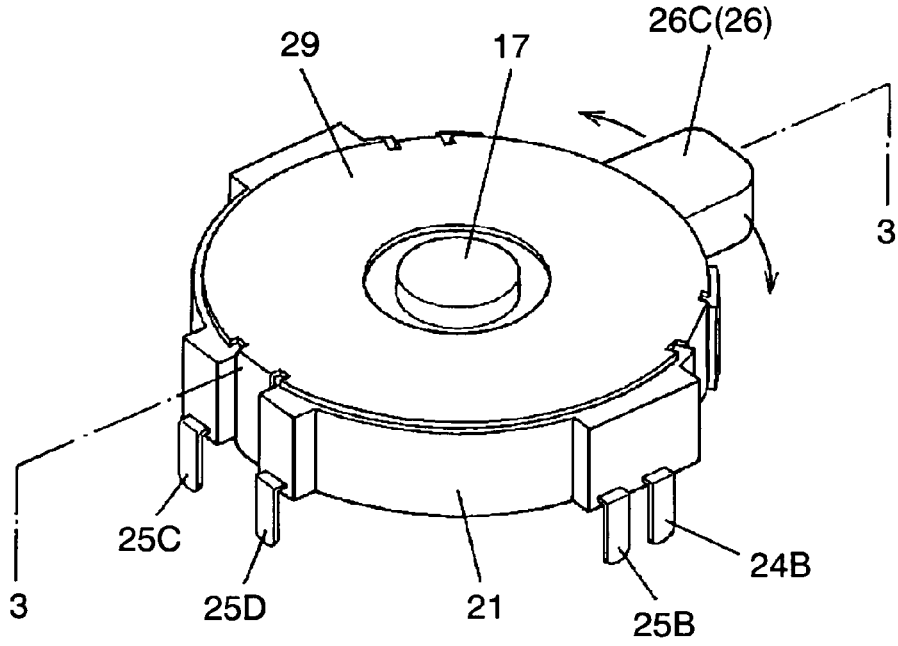
FIG. 2 is an exterior view of the multifunctional switch shown in FIG. 1.
Figure 3:
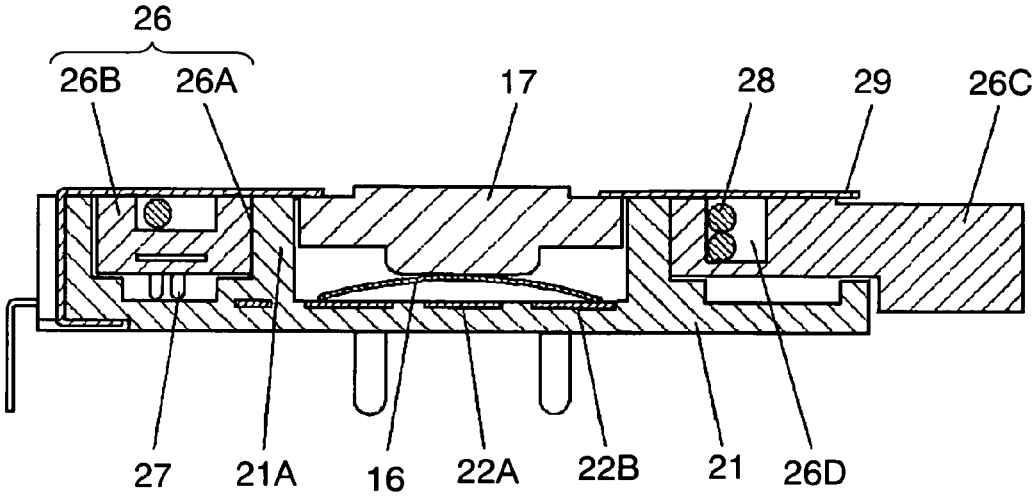
FIG. 3 is a sectional view of the multifunctional switch taken along a line 3-3 of FIG. 2.
Figure 4:
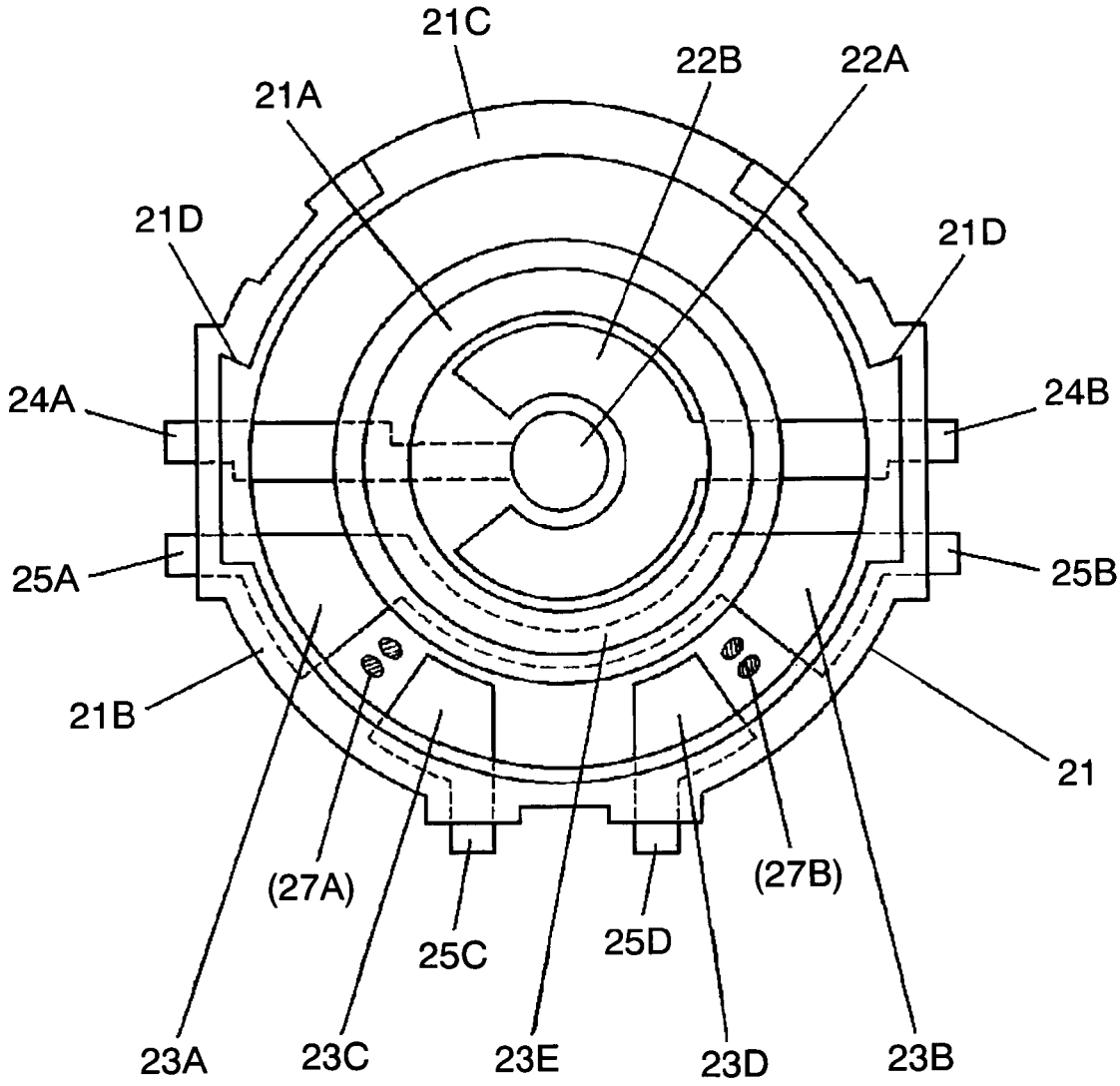
FIG. 4 is a plan view of a switch casing of the multifunctional switch shown in FIG. 1.
Figure 5:
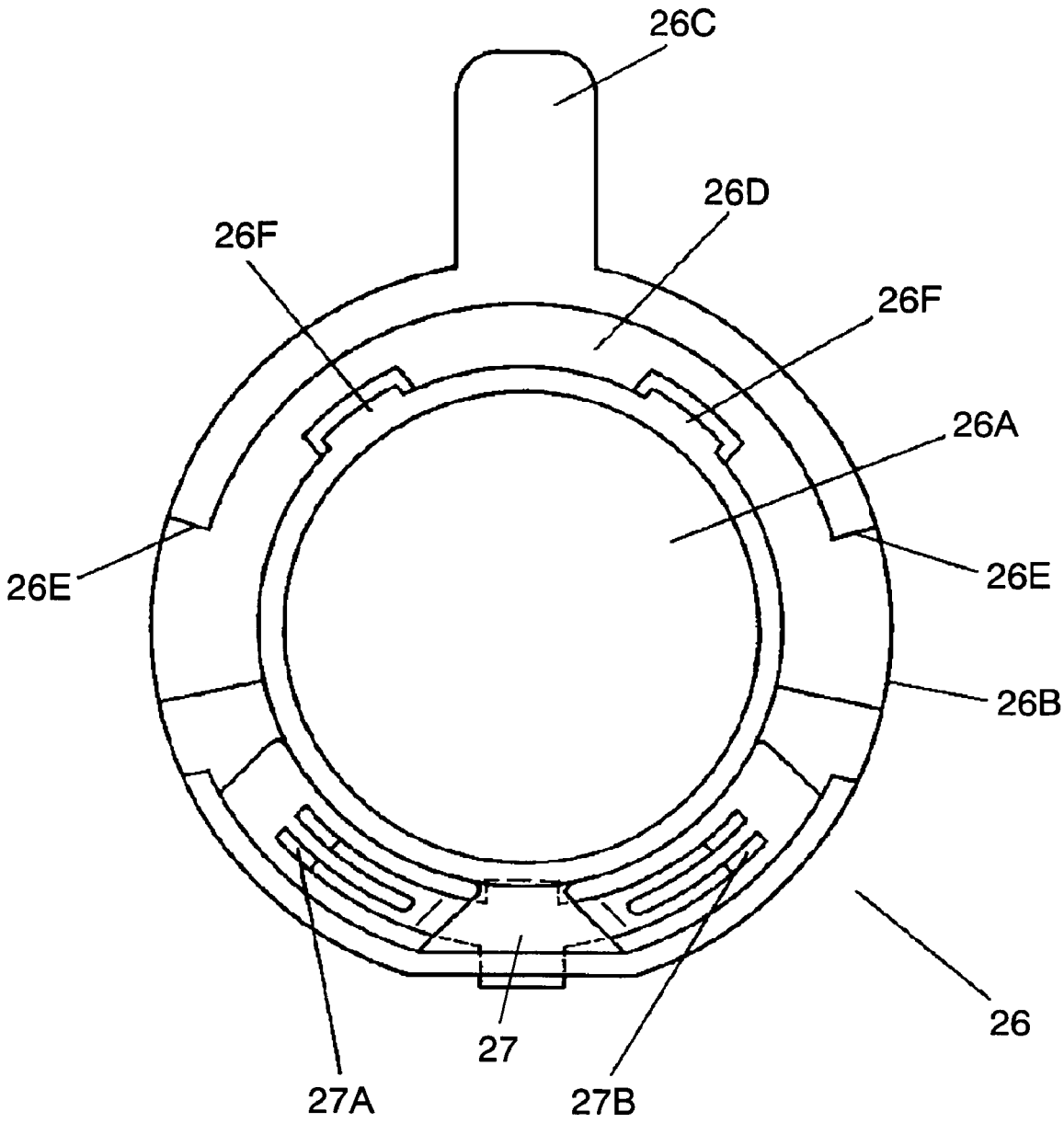
FIG. 5 is a plan view of a rotatable body of the multifunctional switch shown in FIG. 1.
Figure 6:
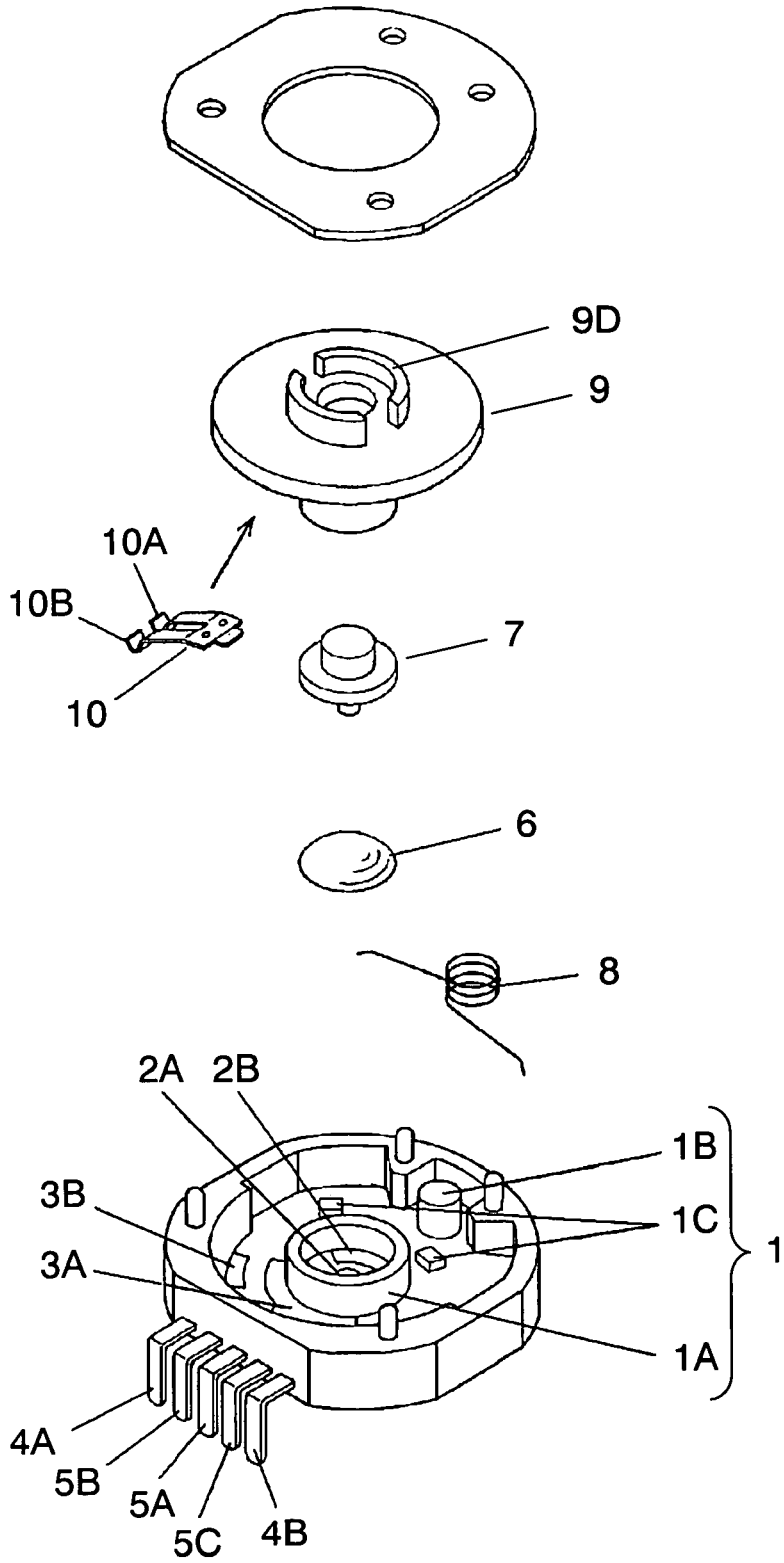
FIG. 6 PRIOR ART
FIG. 6 is an exploded perspective view of a multifunctional switch of the prior art.
Figure 7:
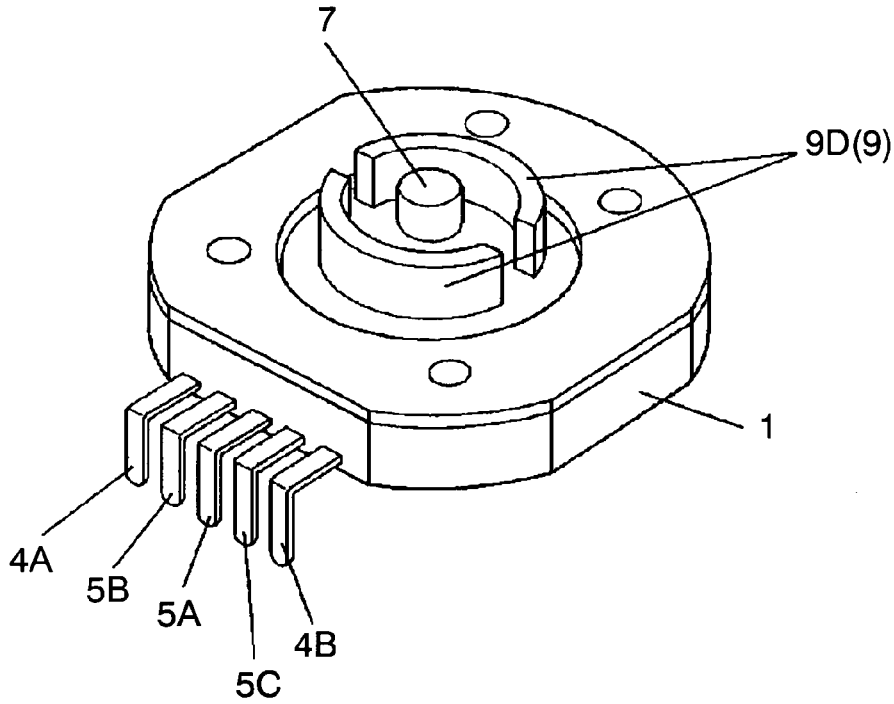
FIG. 7 PRIOR ART
FIG. 7 is an exterior view of the multifunctional switch shown in FIG. 6.
Figure 8:
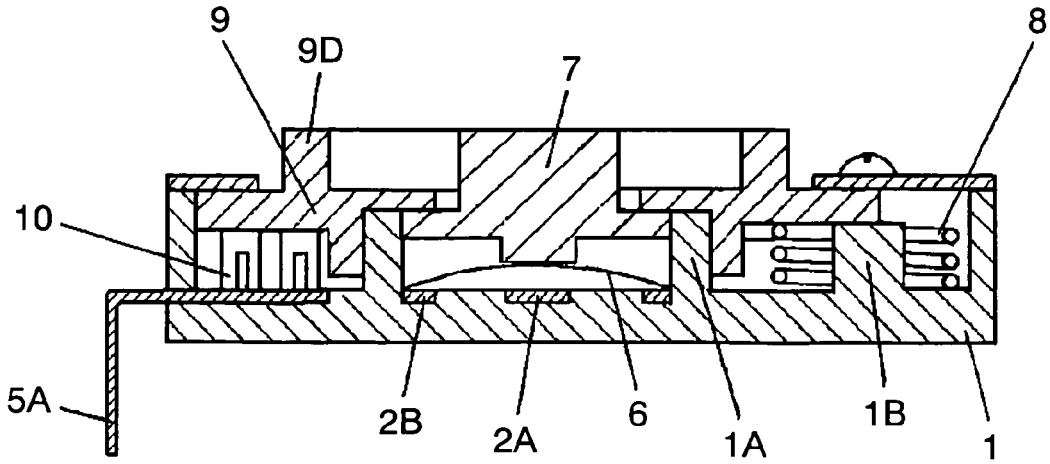
FIG. 8 PRIOR ART
FIG. 8 is a sectional view of the multifunctional switch of FIG. 7.
Figure 9:
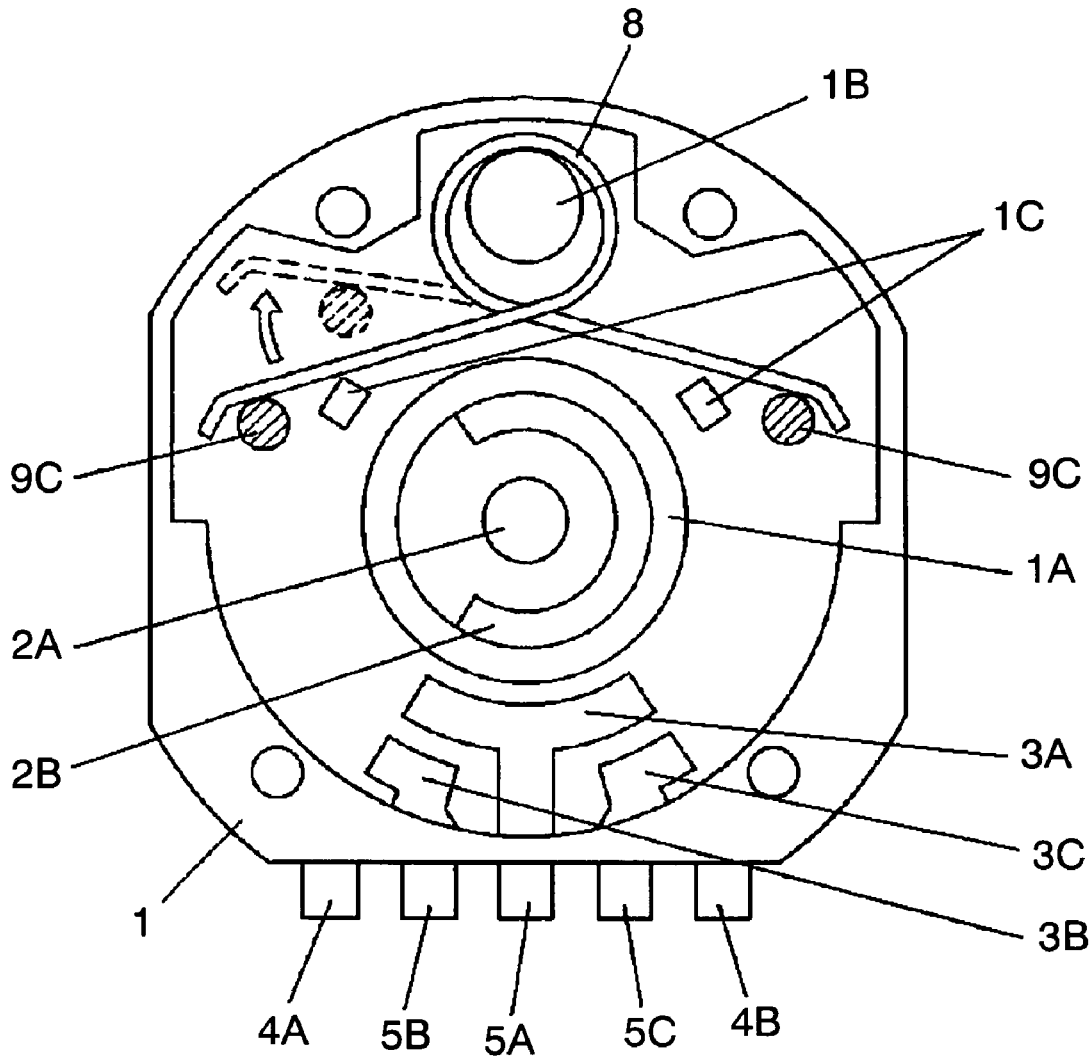
FIG. 9 PRIOR ART
FIG. 9 is a plan view of a switch casing of the multifunctional switch shown in FIG. 6.

FIG. 1 is an exploded perspective view of a multifunctional switch according to the exemplary embodiment of this invention, FIG. 2 an exterior view of the same switch, FIG. 3 a sectional view of the same switch, FIG. 4 a plan view of a switch casing, and FIG. 5 a plan view of a rotatable body.

There are contacts 22A and 22B for a push switch disposed inside circular wall 21A of switch casing 21. Contacts 22A and 22B are connected with terminals 24A and 24B respectively.

There are also disposed contacts 23A, 23B, 23C and 23D for a rotary switch on a bottom surface between circular wall 21A and outer wall 21B, as shown in FIG. 4. Contacts 23A, 23B, 23C and 23D are connected with terminals 25A, 25B, 25C and 25D respectively. Contacts 23A and 23B are electrically equipotential as they are connected with circular arc connector 23E embedded in the bottom of switch casing 21.

Dome-like movable contact 16 made of a sheet metal and push button 17 together with contacts 22A and 22B compose the push switch inside circular wall 21A. A peripheral rim of dome-like contact 16 is in contact with contact 22B.

Rotatable body 26 made of a resin material is engaged in a freely rotatable manner to circular wall 21A of switch casing 21. Rotatable body 26 has center hole 26A, circular portion 26B and operating lever 26C protruding from the side of circular portion 26B. Operating lever 26C further projects laterally from switch casing 21 through opening 21C in outer wall 21B, and it can be used for operation of the rotary switch.

In addition, rotatable body 26 has sliding contact 27 made of a flexible sheet metal on the side opposite operating lever 26C, as shown in FIG. 5. Sliding contact 27 has a center portion fixed to rotatable body 26, and two sets of flexible arms provided with contact shoes 27A and 27B at their ends. The two sets of flexible arms extend downward at an angle from rotatable body 26.

Contact shoes 27A and 27B stay in contact with an insulated surface between the contacts, as shown by diagonally shaded marks in FIG. 4, when rotatable body 26 is in its neutral position.

After rotatable body 26 and switch casing 21 are assembled together, coil spring 28 of approximately one and a half turns is disposed inside spring groove 26D in rotatable body 26 while bending it with a torsion. Bosses 26F in spring groove 26D prevent spring 28 from coming out of spring groove 26D. Both ends 28B of spring 28 abut with a thrust upon cut openings 26E of rotatable body 26 and recesses 21D in switch casing 21.

Cover 29 is mounted to switch casing 21 to thus prevent push button 17 and rotatable body 26 from coming upward.

The push switch and the rotary switch operate in a manner which is described hereinafter.

When push button 17 of the push switch is pressed, the dome-like shape of movable contact 16 elastically deforms downward to come into contact with contact 22A, thereby making a continuity between terminals 24A and 24B. When the pressing force is removed from push button 17, movable contact 16 recovers its original dome-like shape, comes off contact 22A, and breaks the continuity between terminals 24A and 24B.

When a turning force is applied clockwise to operating lever 26C of the rotary switch, rotatable body 26 rotates and shifts contact shoes 27A and 27B of sliding contact 27 to respective positions in contact with contacts 23A and 23D to thus make a continuity between terminals 25A and 25D. One end 28B of spring 28 is pushed in the winding direction of coil spring 28 by one of cut openings 26E corresponding to it, while the other end of spring 28 is held immovable by one of recesses 21D, thereby providing spring 28 with an energy to function as a torsion spring.

When the turning force is removed, the energy stored in spring 28 causes rotatable body 26 to return to its original position, or the neutral position, and both contact shoes 27A and 27B to return to the original positions on the insulated surface, thereby breaking the continuity between terminals 25A and 25D.

When a turning force is applied counterclockwise to rotatable body 26, it rotates in the direction opposite the above and makes a continuity between terminals 25C and 25B. Removal of the turning force breaks the continuity between terminals 25C and 25B.

As discussed, the multifunctional switch of this invention includes both the push switch and the rotary switch in such a configuration that the rotary switch can be operated in a plane orthogonal to an operating direction of the push switch. The rotary switch has the plurality of contacts arranged in the same circumferential area around circular wall 21A in a concentrical manner with circular wall 21A in order to reduce a diametrical dimension. In addition, the structure having spring 28 disposed inside spring groove 26D in rotatable body 26 also contributes to further reduction of the diametrical dimension. Moreover, spring 28 of large diameter helps improve steadiness of operation and low profiling of the product.

The present invention is adaptable to many variations such as a change in arrangement of the contacts inside switch casing 21 on the basis of the above structure.

Since the multifunctional switch of the present invention has the rotary switch which is operable in the plane orthogonal to the operating direction of the push switch, it is useful for such application as a cellular phone, a digital still camera, and the like.

What is claimed is:

1. A multifunctional switch comprising:

a switch casing having a circular wall formed vertically in the center thereof;

a push switch provided inside the circular wall;

a rotary switch provided outside of the circular wall; and a cover mounted to the switch casing and covering a rotatable body, wherein the rotary switch having:

a plurality of contacts arranged in a same circumferential area around the circular wall in a concentrical manner with the circular wall;

the rotatable body engaged rotatably to the circular wall;

a spring disposed to the rotatable body in a manner that both ends abut with a thrust upon the rotatable body and the switch casing;

a sliding contact mounted to the rotatable body for making sliding contact with the plurality of contacts; and an operating lever protruding laterally from the side of the rotatable body beyond the side of the switch casing, and the rotary switch is operable in a plane orthogonal to an operating direction of the push switch using the operating lever.

2. The multifunctional switch as set forth in claim 1, wherein the rotatable body has a groove in an upper surface thereof for fitting the spring, and the groove is provided with a boss at an upper edge for preventing the spring from coming out upward.

* * * * *